US010208467B2

(12) United States Patent
Lin et al.

(10) Patent No.: US 10,208,467 B2
(45) Date of Patent: Feb. 19, 2019

(54) SEAMLESS QUICK-RELEASE STRAINER STRUCTURE FOR METAL SINK

(71) Applicants: Kuan Chieh Lin, Taichung (TW); Yun Yan Lin, Taichung (TW)

(72) Inventors: Kuan Chieh Lin, Taichung (TW); Yun Yan Lin, Taichung (TW)

( * ) Notice: Subject to any disclaimer, the term of this patent is extended or adjusted under 35 U.S.C. 154(b) by 0 days.

(21) Appl. No.: 15/849,626

(22) Filed: Dec. 20, 2017

(65) Prior Publication Data

US 2018/0112381 A1 Apr. 26, 2018

(51) Int. Cl.
*E03C 1/262* (2006.01)
*E03C 1/264* (2006.01)

(52) U.S. Cl.
CPC ..... *E03C 1/262* (2013.01); *E03C 1/264* (2013.01)

(58) Field of Classification Search
CPC ... E03C 1/22; E03C 1/26; E03C 1/262; E03C 1/264; E03C 1/266; E03C 1/2665
See application file for complete search history.

(56) References Cited

U.S. PATENT DOCUMENTS 2,505,305 A * 4/1950 Schaefer ..... E03C 1/264 4/289
4,188,675 A * 2/1980 Ast ..... E03C 1/262 137/800
7,584,914 B2 * 9/2009 Nishikawa ..... B08B 9/027 134/115 G
8,214,934 B2 * 7/2012 Sullivan ..... E03C 1/262 4/287
9,863,129 B2 * 1/2018 Lin ..... E03C 1/182
2006/0283991 A1 * 12/2006 Nishikawa ..... B08B 9/027 241/46.013
2008/0301871 A1 * 12/2008 Hanson ..... E03C 1/266 4/695
2010/0095444 A1 * 4/2010 Sullivan ..... E03C 1/22 4/287
2012/0180210 A1 * 7/2012 Hanson ..... E03C 1/266 4/695
2015/0259892 A1 * 9/2015 Guterman ..... E03C 1/264 4/291
2016/0076234 A1 * 3/2016 Hammer ..... E03C 1/2665 241/46.016
2017/0030058 A1 * 2/2017 Lin ..... E03C 1/182

* cited by examiner

*Primary Examiner* — Janie Loeppke

(57) ABSTRACT

A seamless quick-release strainer structure includes a water outlet on a bottom of a sink; a strainer attached to the water outlet and including a stepped trough having a lower end provided with a tailpiece connectable to a drain; a circle frame at a periphery of the water outlet extending outwardly from the bottom of the sink; and a connecting sleeve having an outer periphery radially formed with studs. The stepped trough includes an open end facing a lower end of the connecting sleeve formed with a receiving circular frame, the receiving circular frame having an outer periphery provided with a locking sleeve, the locking sleeve having retaining slots corresponding to the studs respectively. Each retaining slot includes an opening and a retaining portion. Each stud slides to position in the retaining portion.

8 Claims, 6 Drawing Sheets

SEAMLESS QUICK-RELEASE STRAINER STRUCTURE FOR METAL SINK

BACKGROUND OF THE INVENTION

1. Technical Field

The present invention relates to a seamless quick-release strainer structure for a metal sink that provide quick-release connection at a water outlet of the strainer.

2. Description of Related Art

The conventional kitchen sinks are usually made of metal, particularly stainless steel, for durability, esthetics and easy cleaning and maintenance. These metal sinks are where people wash kitchenware, dishes and foods. For preventing drain clog, a strainer as a typical accessory is attached to a water outlet of a metal sink for filtering out solids from waste water using its filter. As a cost-sensitive decision, metal sinks are usually made of thin metal plates and thus have thin walls. The thin bottom makes it difficult to attach a strainer to the drain end of the water outlet. A known kitchen sink strainer is inserted into a water outlet of a sink and juts out of the lower surface of the bottom of the sink with a retaining rim of the strainer held by the upper surface of the bottom of the sink. Then a locking ring, working with a washer, is screwed to the externally threaded segment of the strainer from the lower surface of the bottom of the sink, so as to fix the strainer to the water outlet. However, no matter how thin the washer is or even if the washer is not used, there is unavoidably a seam between the retaining rim and the sink bottom. Such a seam can catch dirt, breed mold, and become stinky, and adds difficulty in cleaning and maintenance. All these are adverse to esthetics and hygiene at the sink. In addition, there is usually a cabinet under a kitchen sink for storing articles, and when it is necessary to detach the strainer from the water outlet for maintenance or cleaning, disassembly of the multi-circle locking ring can be hindered by the ambient articles, so the assembly and disassembly of the known strainer are inconvenient.

SUMMARY OF THE INVENTION

The primary objective of the present invention is to provide a seamless quick-release strainer structure for a metal sink that is a stainless steel sink with its sink bottom formed with a water outlet and a strainer attached to the water outlet and including therein a stepped trough whose lower end is provided with a tailpiece to be connected to a drain. Therein, the sink bottom of the metal sink has a circle frame integratedly extending outward from the sink bottom at a periphery of the water outlet. The circle frame is peripherally mounted with a connecting sleeve. The connecting sleeve has its outer periphery radially formed with a plurality of studs. The stepped trough of the strainer has an opening end that faces a lower end of the connecting sleeve formed with a receiving circular frame. The receiving circular frame has its outer periphery provided with a locking sleeve. The locking sleeve has its body formed with a plurality of retaining slots positionally corresponding to the studs of the connecting sleeve. Each of the retaining slots has an opening and a retaining portion. The opening and the retaining portion are vertically offset to from upper and lower ends of a guiding segment, respectively. The opening is configured to receive the corresponding stud of the connecting sleeve. By mounting the locking sleeve around the connecting sleeve and fitting the stud into the opening, the stud can be driven to slide along the guiding segment and get positioned in the retaining portion, so that the receiving circular frame of the strainer is locked at the lower end of the connecting sleeve and communicated with the circle frame and the water outlet. At the water outlet at the sink bottom of the metal sink, an inclusive assembly extending from the circle frame to the opening end of the stepped trough of the strainer is formed, so that there is no seam left around the water outlet at the sink bottom of the metal sink, thereby bringing the metal sink about benefits about esthetics, easy cleaning and maintenance, and hygiene. By slightly reversing the locking sleeve, the studs of the connecting sleeve can rapidly retreated from the retaining slots of the locking sleeve, thereby quickly releasing the strainer from the circle frame and the water outlet.

Another objective of the present invention is to provide a seamless quick-release strainer structure for a metal sink, wherein the guiding segment of the retaining slot is an inclined groove sloping from the opening toward the retaining portion, so that with the stud of the connecting sleeve fitted into the opening of the retaining slot, the stud can slide down along the guiding segment to the retaining portion and get positioned there by an operator's slightly rotating the locking sleeve outside the connecting sleeve. In this manner, the strainer can be connected and fixed to the circle frame and the water outlet. In addition, the guiding segment has a width slightly smaller than an outer diameter (profile) of the stud 31. When the stud 31 enters from the opening and slides down along the guiding segment, the guiding segment can resiliently expand and then restore its original width, so as to allow the stud to reach the retaining portion, and thereby hold the stud in position and prevent unintentional withdrawal unless a large external force is applied.

Another objective of the present invention is to provide a seamless quick-release strainer structure for a metal sink, wherein the circle frame of the metal sink has its end extended with a plurality of fixing pieces, and the connecting sleeve has its one end peripherally formed with a plurality of clipping recesses positionally corresponding to the fixing pieces. Each of the fixing pieces can be bent and inlaid into the corresponding clipping recesses, so as to fix the connecting sleeve to an outer periphery of the circle frame, thereby easily achieving permanent and firm attachment of the connecting sleeve to the circle frame.

Another objective of the present invention is to provide a seamless quick-release strainer structure for a metal sink, wherein the receiving circular frame at the opening end of the stepped trough of the strainer receives a strainer basket. The strainer basket has its entrance end provided with an upper filter to be filled at an inner periphery of the circle frame. The upper filter is provided with a bored portion and is formed with a pit. The pit is to receive a stopper for sealing the bored portion. When the metal sink is filled with water, the stopper installed prevents water in the metal sink from falling into the strainer and draining away. On the contrary, when the stopper is removed, the waste water in the metal sink drains away through the strainer. At this time, the bored portion of the upper filter and holes formed on the strainer basket can filter solids and allow water to pass therethrough.

Still another objective of the present invention is to provide a seamless quick-release strainer structure for a metal sink, wherein between the lower end of the connecting sleeve and the receiving circular frame of the strainer, a seal washer is installed. As the locking sleeve is operated, the stud of the connecting sleeve enters the retaining slot of the locking sleeve, and slides along the guiding segment to get positioned in the retaining portion, and meanwhile the locking sleeve drives the receiving circular frame to closely fit the seal washer so as to form water seal packing, thereby locking the strainer to the connecting sleeve without water leakage.

Yet another objective of the present invention is to provide a seamless quick-release strainer structure for a metal sink, wherein the receiving circular frame of the strainer is formed as a flange, and the locking sleeve is assembled to the receiving circular frame. A supporting ring is form on the locking sleeve to support a lower surface of the receiving circular frame. When the locking sleeve is combined with the connecting sleeve, the supporting ring of the locking sleeve draws the receiving circular frame of the strainer toward the lower end of the connecting sleeve, so that the assembling or disassembling operation between the locking sleeve and connecting sleeve can be performed without having the strainer move with the operation of the locking sleeve, so as to accomplish connection and disconnection between the receiving circular frame of the strainer and the circle frame of the metal sink, thereby allowing the strainer to be quickly assembled to or disassembled from the water outlet of the metal sink.

A further objective of the present invention is to provide a seamless quick-release strainer structure for a metal sink, wherein the locking sleeve is a locking sleeve body provided with a plurality of the retaining slots. The retaining slots have their lower edge integratedly connected to the outer periphery of the receiving circular frame of the strainer, so that the strainer and the locking sleeve can be formed as an integer using injection molding of plastic, thereby lowering manufacturing costs.

DETAILED DESCRIPTION OF THE INVENTION

The invention as well as a preferred mode of use, further objectives and advantages thereof will be best understood by reference to the following detailed description of illustrative embodiments when read in conjunction with the accompanying drawings.

Figure 1:
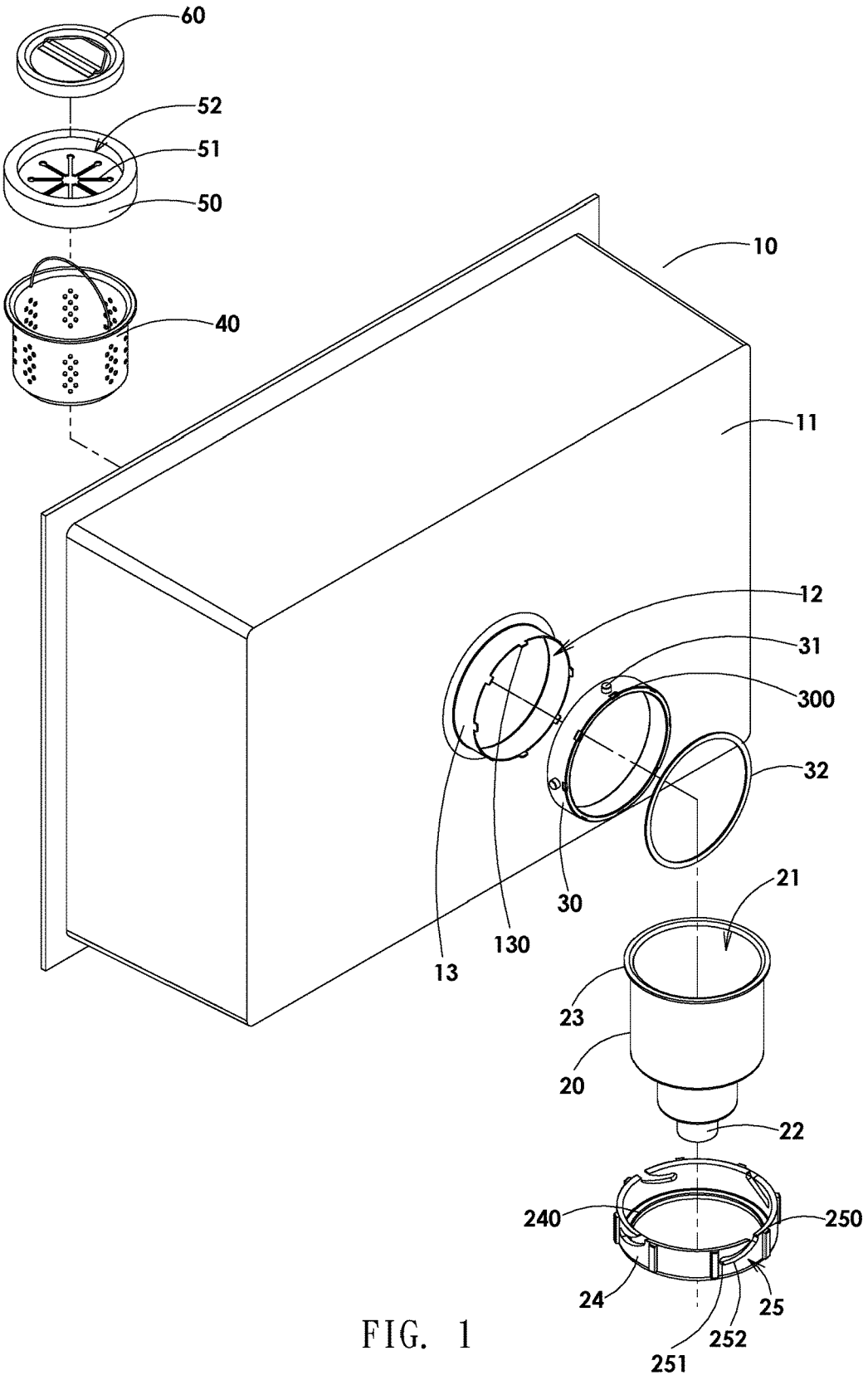
FIG. 1 is an exploded view of a strainer structure of a first embodiment of the present invention.
Figure 2:
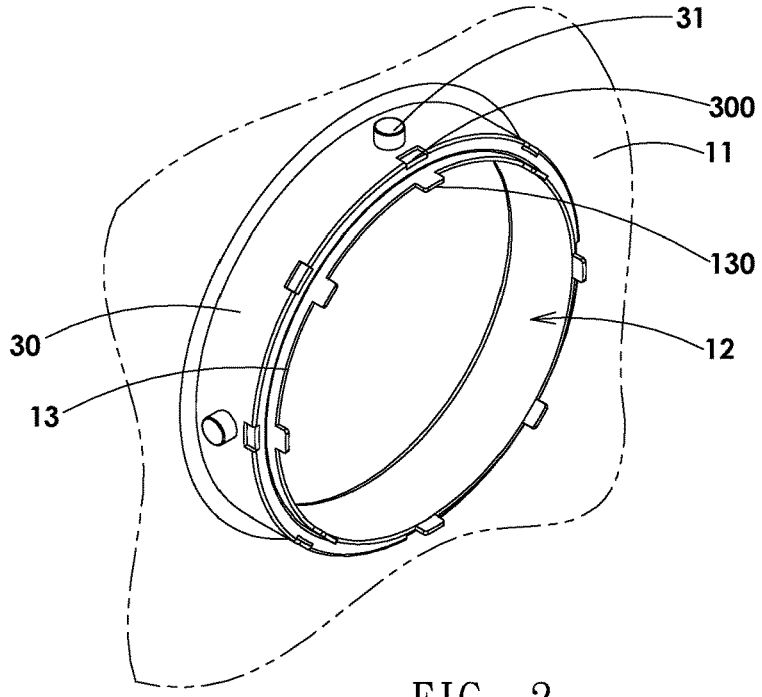
FIG. 2 is a perspective view of a circle frame and a connecting sleeve to be assembled according to the present invention.
Figure 3:
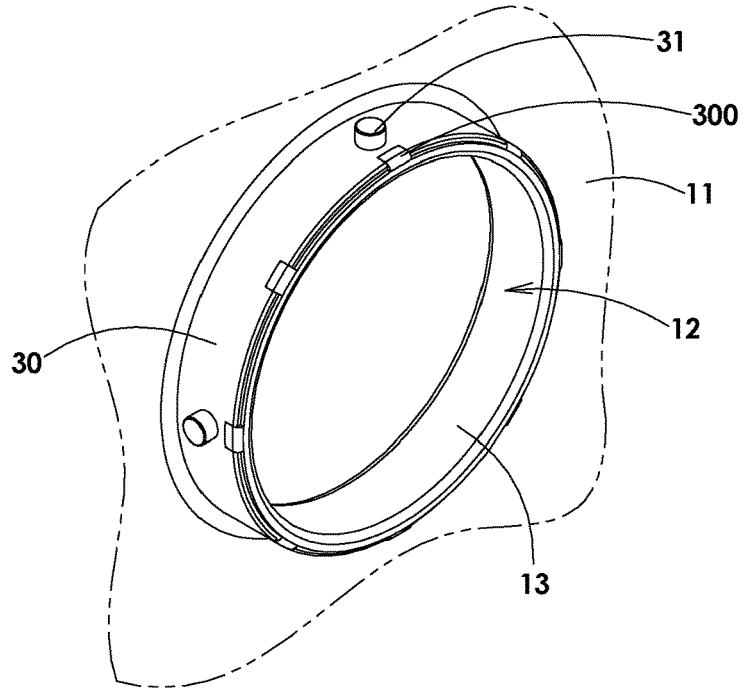
FIG. 3 is a perspective view of the circle frame and the connecting sleeve that are assembled according to the present invention.
Figure 4:
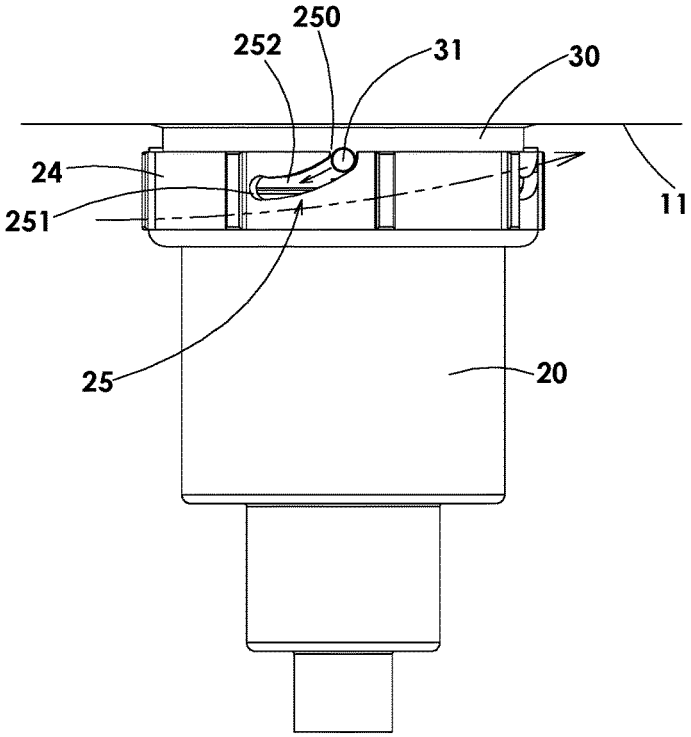
FIG. 4 is a schematic drawing showing a rotational operation to lock a locking sleeve and the connecting sleeve together according to the present invention.
Figure 5:
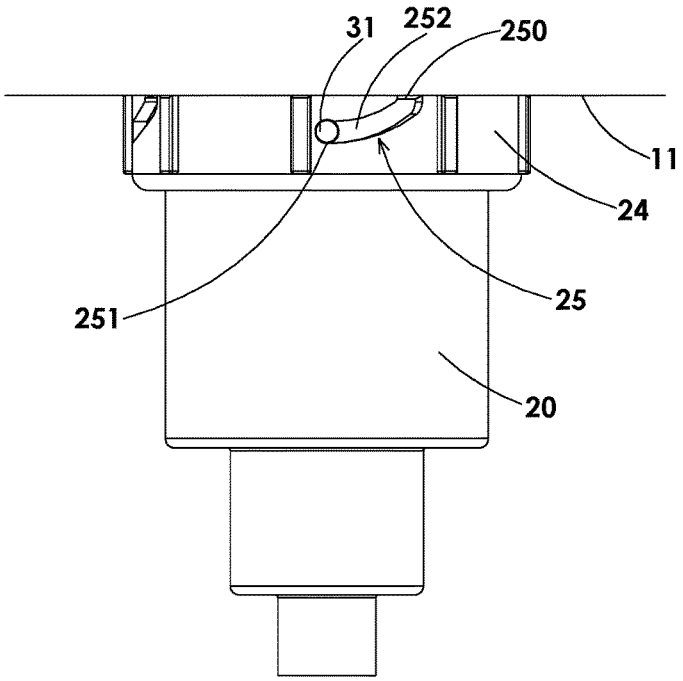
FIG. 5 is a schematic drawing showing the locking sleeve and the connecting sleeve are locked together according to the present invention.

A seamless quick-release strainer structure of the present invention, as shown in FIGS. 1, 2, 3, 4, 5, and 6, is a stainless steel sink 10 with its sink bottom 11 formed with a water outlet 12 and a strainer 20 attached to the water outlet 12 and including therein a stepped trough 21 whose lower end is provided with a tailpiece 22 to be connected to a drain (not shown). Therein, the sink bottom 11 of the metal sink 10 has a circle frame 13 integratedly extending outward from the sink bottom 11 at a periphery of the water outlet 12. The circle frame 13 is peripherally mounted with a connecting sleeve 30. The connecting sleeve 30 has its outer periphery radially formed with a plurality of studs 31. The stepped trough 21 of the strainer 20 has an opening end that faces a lower end of the connecting sleeve 30 formed with a receiving circular frame 23. The receiving circular frame 23 has its outer periphery provided with a locking sleeve 24. The locking sleeve 24 has its body formed with a plurality of retaining slots 25 positionally corresponding to the studs 31 of the connecting sleeve 30. Each of the retaining slots 25 has an opening 250 and a retaining portion 251. The opening 250 and the retaining portion 251 are vertically offset from each other, so as to form upper and lower ends of a guiding segment 252, respectively. The opening 250 is configured to receive the corresponding stud 31 of the connecting sleeve 30. By mounting the locking sleeve 24 around the connecting sleeve 30 and fitting the stud 31 into the opening 250 (as shown in FIGS. 4 and 5), the stud 31 can be driven to slide along the guiding segment 252 and get positioned in the retaining portion 251, so that the receiving circular frame 23 of the strainer 20 is locked at the lower end of the connecting sleeve 30 and communicated with the circle frame 13 and the water outlet 12. As shown in FIGS. 2 and 3, at the water outlet 12 at the sink bottom 11 of the metal sink 10, an inclusive assembly extending from the circle frame 13 to the opening end of the stepped trough 21 of the strainer 20 is formed, so that there is no seam left around the water outlet 12 at the sink bottom 11 of the metal sink 10, thereby bringing the metal sink 10 about benefits about esthetics, easy cleaning and maintenance, and hygiene. By reversing the locking sleeve 24 for a small angle (in opposite direction as that shown in FIGS. 4 and 5), the studs of the connecting sleeve 30 can rapidly retreated from the retaining slots 25 of the locking sleeve 24, thereby quickly releasing the strainer 20 from the circle frame 13 and the water outlet 12.

According to the above embodiment, the retaining slot 25 of the locking sleeve 24 as shown in FIGS. 1, 4, and 5, the guiding segment 252 of the retaining slot 25 is an inclined groove sloping from the opening 250 toward the retaining portion 251, so that with the stud 31 of the connecting sleeve 30 fitted into the opening 250 of the retaining slot 25, the stud 31 can slide down along the guiding segment 252 to the retaining portion 251 and get positioned there by an operator's slightly rotating the locking sleeve 24 outside the connecting sleeve 30. In this manner, the strainer 20 can be connected and fixed to the circle frame 13 and the water outlet 12. In addition, the guiding segment 252 has a width slightly smaller than an outer diameter (profile) of the stud 31. When the stud 31 enters from the opening 250 and slides down along the guiding segment 252, the guiding segment 252 can resiliently expand and then restore its original width, so as to allow the stud 31 to reach the retaining portion 251, and thereby hold the stud 31 in position and prevent unintentional withdrawal unless a large external force is applied.

According to the above embodiment, as shown in FIGS. 1, 2, and 3, the circle frame 13 of the metal sink 10 has its end extended with a plurality of fixing pieces 130, and the connecting sleeve 30 has its one end peripherally formed with a plurality of clipping recesses 300 positionally corresponding to the fixing pieces 130. Each of the fixing pieces 130 can be bent and inlaid into the corresponding clipping recesses 300, so as to fix the connecting sleeve 30 to an outer periphery of the circle frame 13, thereby easily achieving permanent and firm (non-rotatable) attachment of the connecting sleeve 30 to the circle frame 13.

Figure 6:
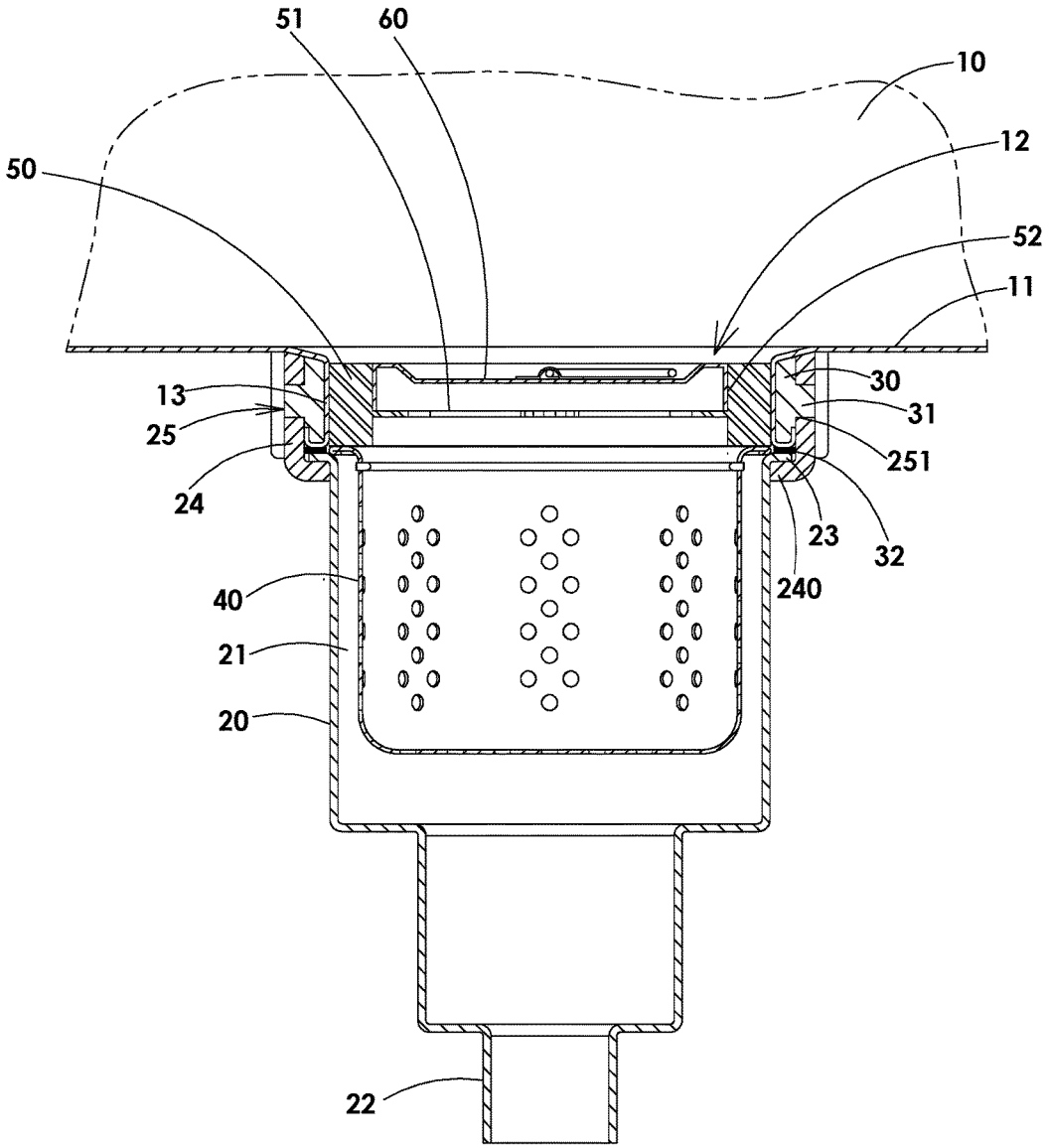
FIG. 6 is of the embodiment of the first embodiment of the present invention.

According to the above embodiment, as shown in FIGS. 1 and 6, the receiving circular frame 23 at the opening end of the stepped trough 21 of the strainer 20 receives a strainer basket 40. The strainer basket 40 has its entrance end provided with an upper filter 50 to be filled at an inner periphery of the circle frame 13. The upper filter 50 is provided with a bored portion 51 and is formed with a pit 52. The pit 52 is to receive a stopper 60 for sealing the bored portion 51. When the metal sink 10 is filled with water (not shown), the stopper 60 installed prevents water in the metal sink 10 from falling (flowing) into the strainer 20 and draining away. On the contrary, when the stopper 60 is removed (not shown), the waste water in the metal sink 10 drains away through the strainer 20. At this time, the bored portion 51 of the upper filter 50 and holes formed on the strainer basket 40 can filter solids and allow water to pass therethrough.

According to the above embodiment, as shown in FIGS. 1, 2, and 3, between the lower end of the connecting sleeve 30 and the receiving circular frame 23 of the strainer 20, a seal washer 32 is installed. As the locking sleeve 24 is rotated (referring to FIGS. 4 and 5), the stud 31 of the connecting sleeve 30 enters the retaining slot 25 of the locking sleeve 24, and slides along the guiding segment 252 to get positioned in the retaining portion 251, and meanwhile the locking sleeve 24 drives the receiving circular frame 23 to closely fit and compress the seal washer 32 so as to form water seal packing, thereby locking the strainer 20 to the connecting sleeve 30 without water leakage.

According to the above embodiment, as shown in FIGS. 1 and 6, the receiving circular frame 23 of the strainer 20 is formed as a flange, and the locking sleeve 24 is assembled to the receiving circular frame 23. A supporting ring 240 is form on the locking sleeve 24 to support a lower surface of the receiving circular frame 23. Referring to FIGS. 4 and 5, when the locking sleeve 24 is rotated and combined with the connecting sleeve 30, the supporting ring 240 of the locking sleeve 24 draws (forcedly pulls) the receiving circular frame 23 of the strainer 20 toward the lower end of the connecting sleeve 30, as shown in FIGS. 4, 5, and 6, so that the assembling or disassembling operation between the locking sleeve 24 and connecting sleeve 30 can be performed without having the strainer 20 rotate with the locking sleeve 24, so as to accomplish connection and disconnection between the receiving circular frame 23 of the strainer 20 and the circle frame 13 of the metal sink 10, thereby allowing the strainer 20 to be quickly assembled to or disassembled from the water outlet 12 of the metal sink 10.

Figure 7:
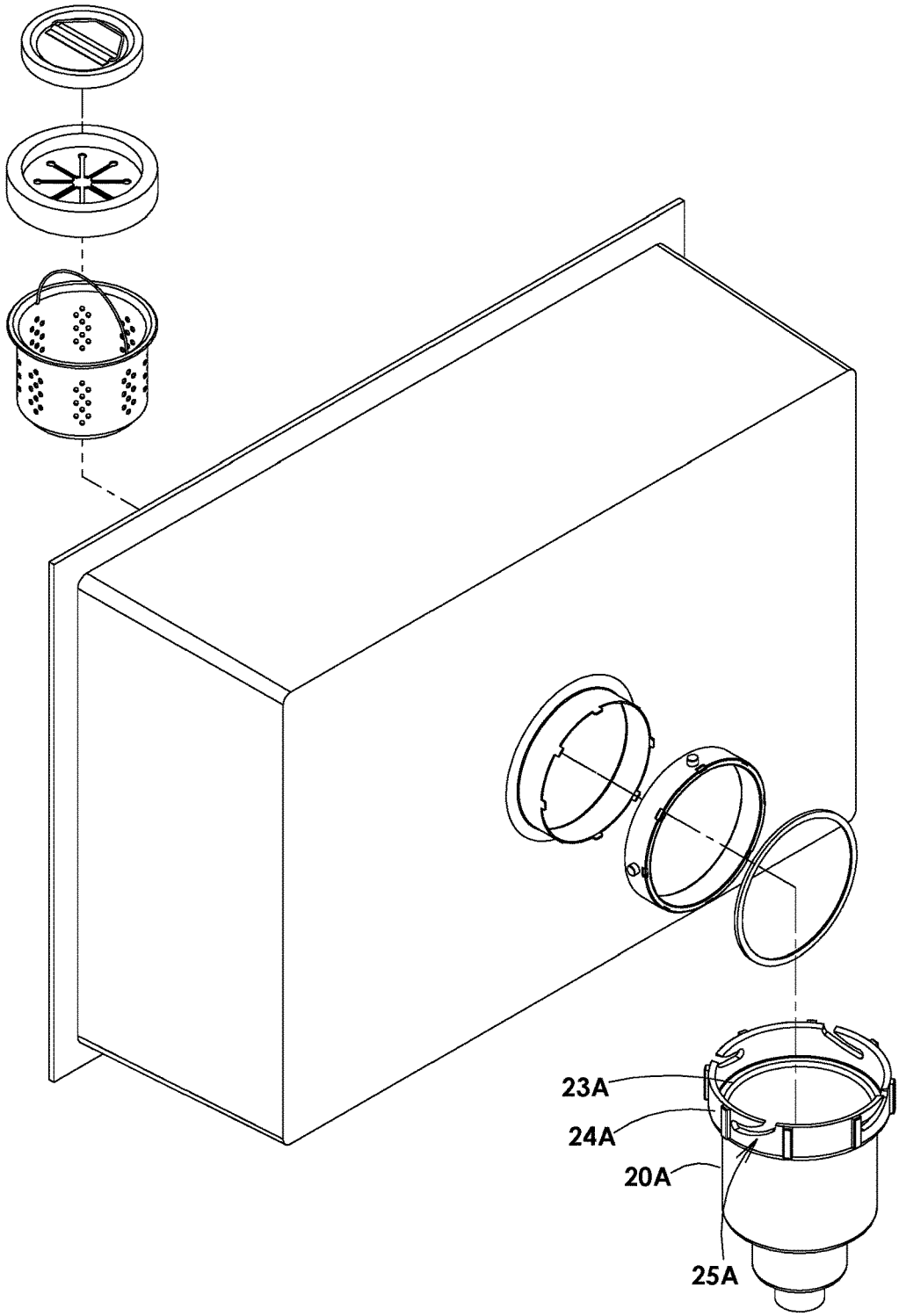
FIG. 7 is an exploded view of a second embodiment of the present invention.
Figure 8:
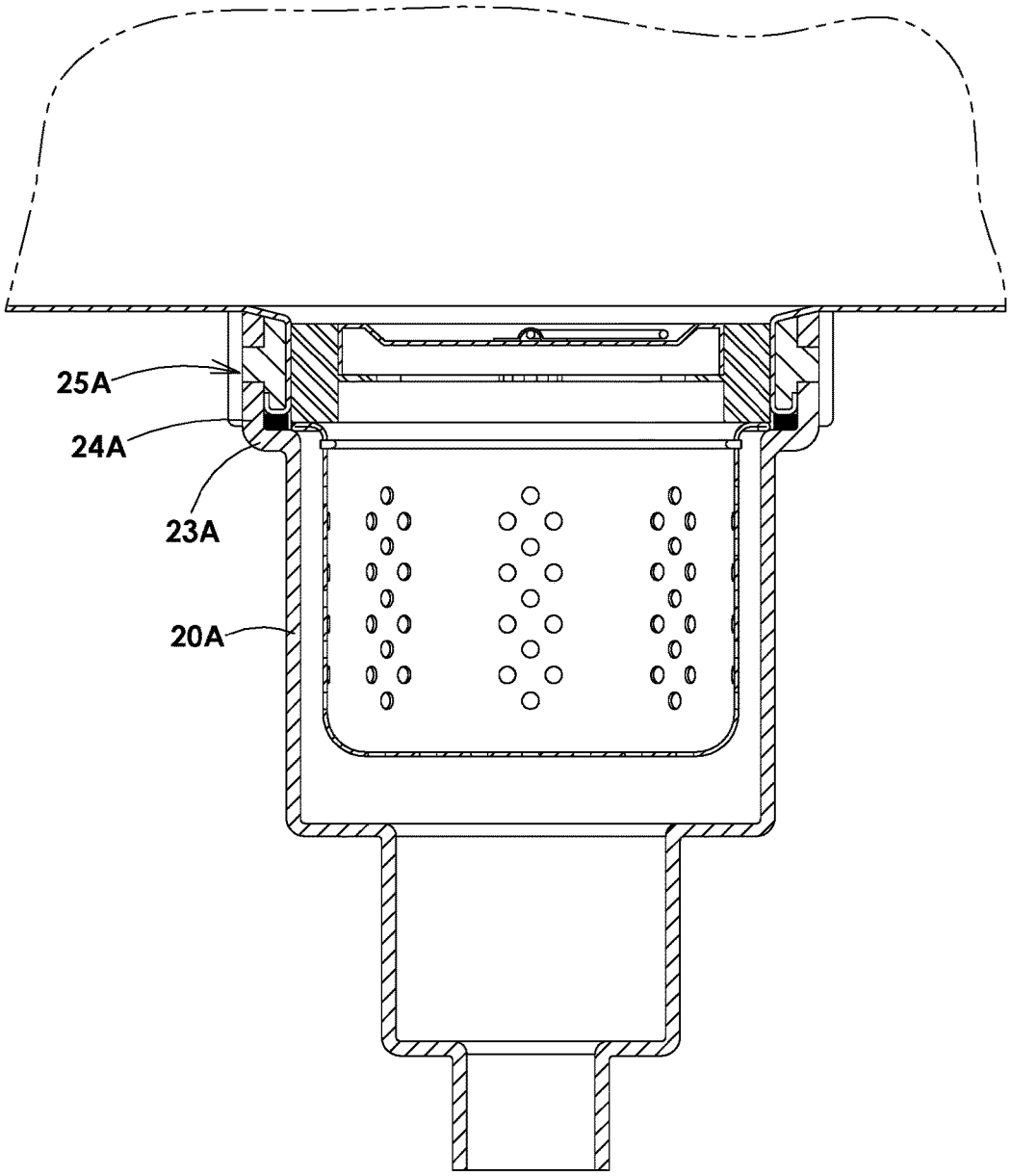
FIG. 8 is a cross-sectional view of the second embodiment of the present invention.

According to another embodiment, as shown in FIGS. 7 and 8, the locking sleeve 24A is a locking sleeve body provided with a plurality of the retaining slots 25A. The retaining slots 25A have their lower edge integratedly connected to the outer periphery of the receiving circular frame 23A of the strainer 20A, so that the strainer 20A and the locking sleeve 24A can be formed as an integer using injection molding of plastic, thereby lowering manufacturing costs.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A seamless quick-release strainer structure for a metal sink, comprising:

a water outlet formed on a bottom of the metal sink;

a strainer attached to the water outlet and including a stepped trough having a lower end provided with a tailpiece connectable to a drain;

a circle frame formed on the bottom of the metal sink, the circle frame at a periphery of the water outlet extending outwardly from the bottom of the metal sink; and a connecting sleeve mounted peripherally with the circle frame and having an outer periphery radially formed with a plurality of studs;

wherein the stepped trough includes an open end facing a lower end of the connecting sleeve formed with a receiving circular frame, the receiving circular frame having an outer periphery provided with a locking sleeve, the locking sleeve having a body formed with a plurality of retaining slots corresponding to the studs respectively;

wherein each of the retaining slots includes an opening and a retaining portion, the opening and the retaining portion being vertically offset from each other to form upper and lower ends of a guiding segment, the opening being configured to receive the corresponding stud by mounting the locking sleeve around the connecting sleeve and fitting the stud into the opening; and wherein each stud is configured to slide along the guiding segment to position in the retaining portion so that the receiving circular frame is locked at the lower end of the connecting sleeve and communicates with both the circle frame and the water outlet.

2. The seamless quick-release strainer structure of claim 1, wherein the guiding segment of the retaining slot is an inclined groove sloping from the opening toward the retaining portion.

3. The seamless quick-release strainer structure of claim 2, wherein the guiding segment has a width smaller than an outer diameter of the stud.

4. The seamless quick-release strainer structure of claim 1, wherein the circle frame of the metal sink has an end extending with a plurality of fixing pieces, and the connecting sleeve has an end peripherally formed with a plurality of clipping recesses corresponding to the fixing pieces respectively, and wherein each of the fixing pieces is configured to be bent and inlaid into the corresponding clipping recess to secure the connecting sleeve to an outer periphery of the circle frame.

5. The seamless quick-release strainer structure of claim 1, wherein the receiving circular frame at the open end of the stepped trough of the strainer receives a strainer basket, the strainer basket having an entrance end provided with an upper filter fillable at an inner periphery of the circle frame, the upper filter being provided with a bored portion and formed with a pit, the pit receiving a stopper for sealing the bored portion.

6. The seamless quick-release strainer structure of claim 1, wherein a seal washer is installed between the lower end of the connecting sleeve and the receiving circular frame of the strainer.

7. The seamless quick-release strainer structure of claim 1, wherein the receiving circular frame of the strainer is formed as a flange so that the locking sleeve is assembled to the receiving circular frame, and a supporting ring is formed on the locking sleeve to support a lower surface of the receiving circular frame.

8. The seamless quick-release strainer structure of claim 1, wherein the locking sleeve is a locking sleeve body provided with the plurality of the retaining slots, each of the retaining slots having a lower edge connected to the outer periphery of the receiving circular frame.

* * * * *